US006824158B1

(12) United States Patent
Keller et al.

(10) Patent No.: US 6,824,158 B1
(45) Date of Patent: Nov. 30, 2004

(54) DEVICE FOR ADJUSTING THE LENGTH OF A SKI SAFETY ATTACHMENT

(75) Inventors: Alexander Keller, Unterammergau (DE); Thomas Tchorsch, Garmisch-Partenkirchen (DE)

(73) Assignee: Marker Deutschland GmbH, Eschenlohe (DE)

( * ) Notice: Subject to any disclaimer, the term of this patent is extended or adjusted under 35 U.S.C. 154(b) by 54 days.

(21) Appl. No.: 10/049,081

(22) PCT Filed: Jul. 13, 2000

(86) PCT No.: PCT/DE00/02282

§ 371 (c)(1),
(2), (4) Date: Jun. 11, 2002

(87) PCT Pub. No.: WO01/10519

PCT Pub. Date: Feb. 15, 2001

(30) Foreign Application Priority Data

Aug. 6, 1999 (DE) ..... 199 36 519
Feb. 4, 2000 (DE) ..... 200 01 929

(51) Int. Cl.[7] ..... A63C 9/08

(52) U.S. Cl. ..... 280/618; 280/617; 280/633; 280/634

(58) Field of Search ..... 280/617, 634, 280/616, 618, 607, 633, 623, 625, 624

(56) References Cited

U.S. PATENT DOCUMENTS

| | | | | |
|---|---|---|---|---|
| 3,987,553 A | | 10/1976 | Salomon | |
| 4,955,633 A | * | 9/1990 | Stritzl et al. | 280/633 |
| 5,251,923 A | | 10/1993 | Stepanek et al. | |
| 5,261,688 A | * | 11/1993 | Rohrmoser | 280/617 |
| 5,344,178 A | * | 9/1994 | Rohrmoser | 280/617 |
| 5,344,179 A | * | 9/1994 | Fritschi et al. | 280/618 |
| 5,348,335 A | * | 9/1994 | Dasarmaux et al. | 280/633 |
| 5,421,602 A | | 6/1995 | Stepanek et al. | |
| 5,498,017 A | * | 3/1996 | Rohrmoser | 280/633 |
| 5,611,559 A | * | 3/1997 | Luitz et al. | 280/617 |
| 5,732,968 A | * | 3/1998 | Wladar et al. | 280/633 |
| 5,794,962 A | * | 8/1998 | Bardin et al. | 280/607 |
| 6,050,591 A | * | 4/2000 | Bardin et al. | 280/633 |
| 6,092,829 A | * | 7/2000 | Mercier | 280/617 |
| 6,471,235 B1 | * | 10/2002 | Luitz et al. | 280/618 |
| 2003/0001363 A1 | * | 1/2003 | Battistella et al. | 280/618 |
| 2003/0155744 A1 | * | 8/2003 | Gorza et al. | 280/618 |

FOREIGN PATENT DOCUMENTS

| | | |
|---|---|---|
| DE | 2 246 668 | 4/1974 |
| DE | 41 35 899 A 1 | 6/1992 |
| DE | 42 30 392 A 1 | 4/1993 |
| EP | 0 492 658 B1 | 7/1992 |

* cited by examiner

*Primary Examiner*—Christopher P. Ellis
*Assistant Examiner*—J. Allen Shriver
(74) *Attorney, Agent, or Firm*—D. Peter Hochberg; Sean Mellino; Katherine R. Vieyra

(57) ABSTRACT

This invention concerns a basic arrangement of a ski binding having a front part or a toe end and a rear part or a heel end for securing the ski boot, and also having a front supporting part, longitudinally displaceable on a first base part fixed on the ski, for supporting the front boot holding part, and a rear supporting part, longitudinally displaceable on another base part fixed on the ski, for supporting the rear boot holding part. The invention further includes an adjusting device designed as a rack-and-pinion gear for simultaneous adjustment of both supporting parts; this adjusting device has two toothed racks, each connected to a supporting part, and a manually operable, lockable gearwheel which meshes with both toothed racks between the two supporting parts. In one embodiment, the gearwheel is arranged on a middle base part in an essentially stationary mount on the ski, and is separate from the front and rear base parts, and is held indirectly on the ski by the front and rear base parts. In another embodiment, the gearwheel has an unlocked position which is raised vertically relative to the top side of the ski for the rotational adjustment, and a locked position which is depressed toward the top side of the ski.

9 Claims, 10 Drawing Sheets

DEVICE FOR ADJUSTING THE LENGTH OF A SKI SAFETY ATTACHMENT

BACKGROUND OF THE INVENTION

1. Field of the Invention

This invention concerns a basic arrangement of a ski binding having a front part or a toe end and a rear part or a heel end for securing the ski boot, with a front supporting part, longitudinally displaceable on a first base part fixed on the ski, for the front boot holding part and a rear supporting part, longitudinally displaceable on another base part fixed on the ski, for the rear boot holding part, and with an adjusting device designed as a rack-and-pinion gear for simultaneous adjustment of both supporting parts, having two toothed racks, each connected to a supporting part, and a manually operable, lockable gearwheel which meshes with both toothed racks between the two supporting parts.

2. Description of the Prior Art

Such a basic arrangement is the object of Austrian Patent 2630/90. According to this publication, the toothed racks in the area of the gearwheel pass through a housing which is designed on the one hand as a bearing housing for the gearwheel and on the other hand as a toothed rack guide and holds the toothed racks constantly in a plane falling in the radial mid-plane of a gearwheel. This housing is movable in the direction of the vertical axis of the ski, i.e, the vertical position of this housing is defined by the toothed racks, and with flexing movements of the ski, the vertical spacing of the housing changes relative to the top side of the ski. A similar device is found in the German Patent DE 41 35 899. Again, the device, which is in the middle of the ski, rises from the ski when the ski is bent.

By contrast, in Salomon, U.S. Pat. No. 3,987,553, a ski binding adjustment device having a gear in a box which is screwed to the ski is presented. Since the box is fixedly attached to the ski, this device has no free movement and no flexibility when the ski bends.

In practice, this design has not proven successful, because with flexing movements of the ski, considerable stresses can occur between the housing and the toothed racks, so that after prolonged use, the correct engagement of gearwheel and toothed racks cannot be guaranteed with the desired certainty.

SUMMARY OF THE INVENTION

Essentially a basic arrangement of the type defined in the preamble, however, offers the advantageous possibility of adapting a binding quickly to different ski boot sizes. Ski bindings with such basic parts are therefore especially suitable for use as loaners.

The object of this invention is to guarantee a high operating reliability with a basic arrangement of the type defined in the preamble with a simple construction.

This object is achieved according to this invention by the fact that the gearwheel has a locked position rigidly mounted on the ski and the toothed racks are mounted so they can pivot about a transverse axis in the meshing zone of the gearwheel.

This invention is based on the general idea of preselecting a fixed position for the locked gearwheel relative to the neighboring zone of the. ski and designing the meshing of the gearwheel and toothed rack so that the toothed racks remain tiltable about a transverse axis of the ski in the meshing zone and accordingly can largely freely follow flexing movements of the ski in which the front and rear end of the ski are bent upward relative to the middle of the ski.

The meshing zone can be predefined accurately by a ski-side support of the toothed racks at the aforementioned pivot axis.

According to a preferred embodiment of this invention, the gearwheel is arranged on another base part which is separate from the front and rear base parts and is essentially stationary on the ski and can be indirectly over the front and rear base parts in a stationary mount on the ski in an especially preferred manner. According to this embodiment, the base parts for guiding the carrying parts and for bearing of the gearwheel are designed in the manner of a flexible linked belt, which can follow the flexing movements of the ski easily.

In addition, in an expedient embodiment of this invention, the gearwheel may be arranged to be axially movable against a spring force such that the spring force of the gearwheel applies tension in the locked position.

Very strong springs may be provided here, so that the gearwheel can be lifted out of its locked position only by means of a separately operated unlocking element.

In the unlocked position of the gearwheel, the unlocking element or its handle assumes an obtrusive position which interferes in skiing, so that the fact that it is unlocked will be noticed in any case.

The position of the unlocking element allocated to the locked position of the gearwheel is preferably designed as a catch position, where the spring system putting tension on the gearwheel into its locked position may also act as a catch spring system.

According to an especially preferred embodiment, the gearwheel can be adjusted by means of a lever into the locked position and the unlocked position, whereby in the unlocked position of the gearwheel, the lever projects beyond the longitudinal edge of the ski and is put under tension into its position locking the gearwheel by a spring system. The position of the lever unlocking the gearwheel is expediently designed as top dead center.

DESCRIPTION OF THE DRAWING

Moreover, with regard to preferred features of this invention, reference is made to the claims and the following explanation of the drawing on the basis of which some especially preferred embodiments of this invention are explained in greater detail.

They show.

DESCRIPTION OF THE PREFERRED EMBODIMENTS

Figure 1:
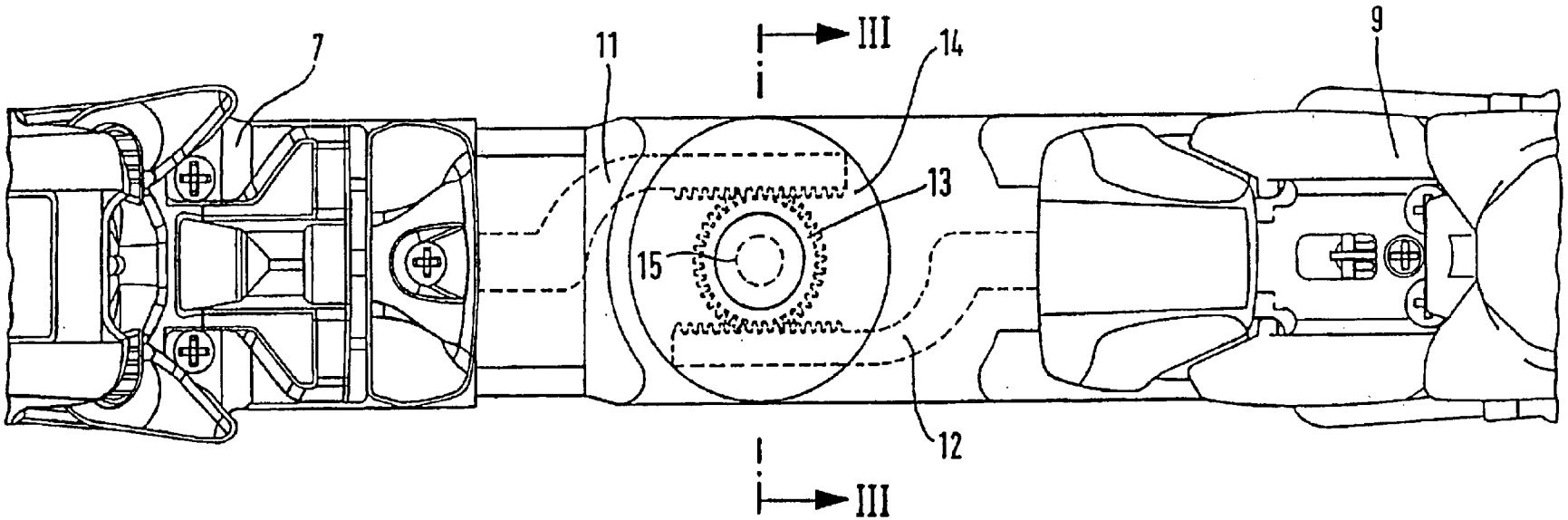
FIG. 1 a top view of a ski binding with a base arrangement according to this invention.
Figure 2:
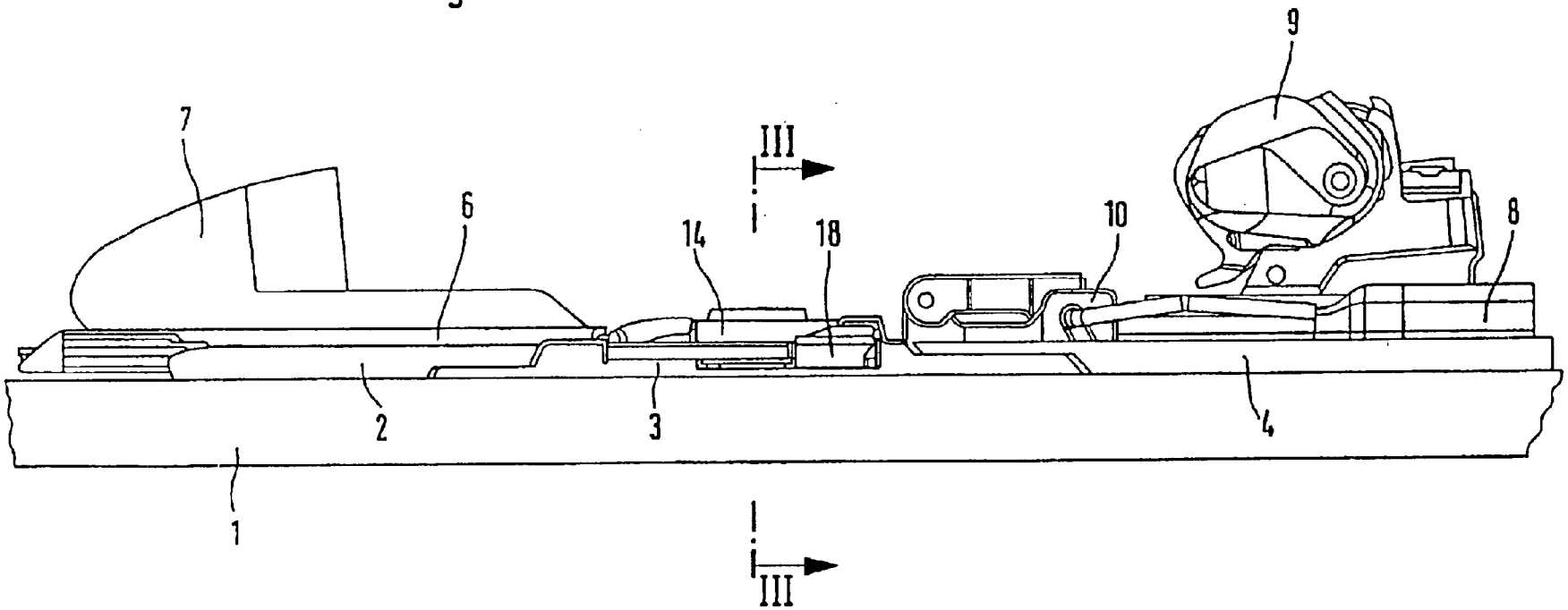
FIG. 2 a schematic side view of the binding mentioned above.

According to FIGS. 1 and 2, flat base parts 2 through 4 are arranged on a ski 1, with only the front and rear base parts 2, 4 being bolted directly to the ski 1 (screws not shown), while the middle base part 3 is secured in a stationary mount on the ski indirectly through the two other base parts 2 and 4. Through a suitable dimensioned gap between the base parts 2 and 4, it is possible to guarantee that the base parts 2 and 4 form a link belt, which freely follows the flexing movements of the ski 1.

Guide rails, e.g., those with a C profile, are arranged on the lateral longitudinal edges of the front and rear base parts 2 and 4, with the concave sides of the rail profiles facing one another. A front supporting part 6 for a ski boot holding part or toe binding 7 on the toe end and a rear supporting part 8 for a ski boot holding part or heel binding 9 on the heel end are displaceably guided, with a ski brake 10 which is connected to the rear supporting 8 or the heel binding 9 being assigned to this part.

Each supporting part 6 and 8 is fixedly connected to a toothed rack 11 and 12, with the teeth on these two toothed racks 11 and 12 being meshed with the gearwheel 13 on a manually operable hand wheel 14, which is rotationally mounted on an axle 15 which is arranged in a fixed mount on a base part 3 and is visible only in FIG. 3; it is adjustable axially in a manner to be explained below between a locked position in which hand wheel 14 cannot be rotated with the gearwheel and an adjustment position in which the hand wheel can be rotated with the gearwheel with a simultaneous adjustment of the supporting parts 6 and 8 as well as the ski boot holding parts 7 and 9.

Figure 3:
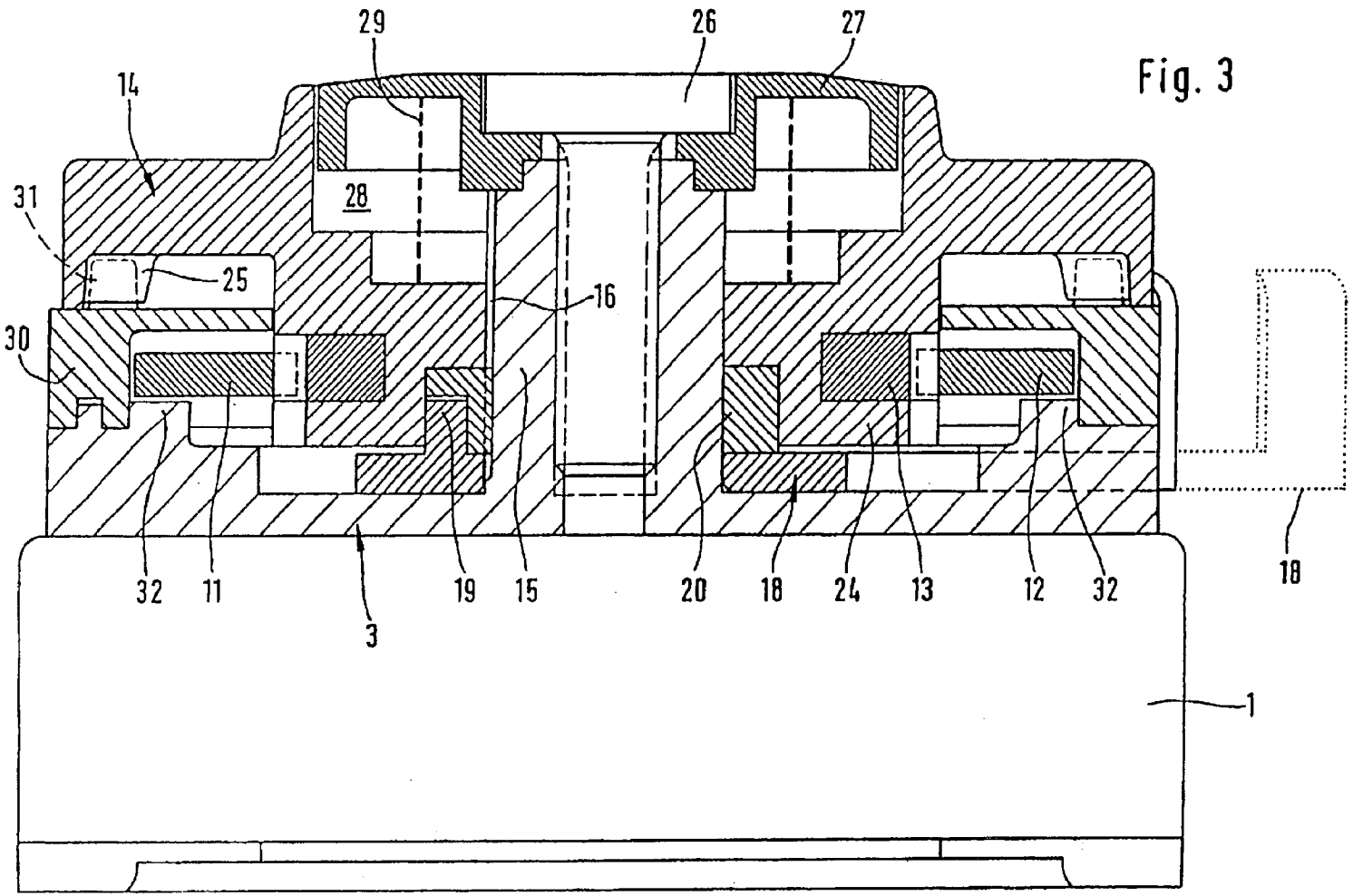
FIG. 3 a sectional view according to sectional line IIIIII in FIGS. 1 and 2.

According to FIG. 3, the axle 15 integrally molded on the base part 3 has a central inside thread borehole and axial grooves 16 on its outer circumference.

Figure 5:
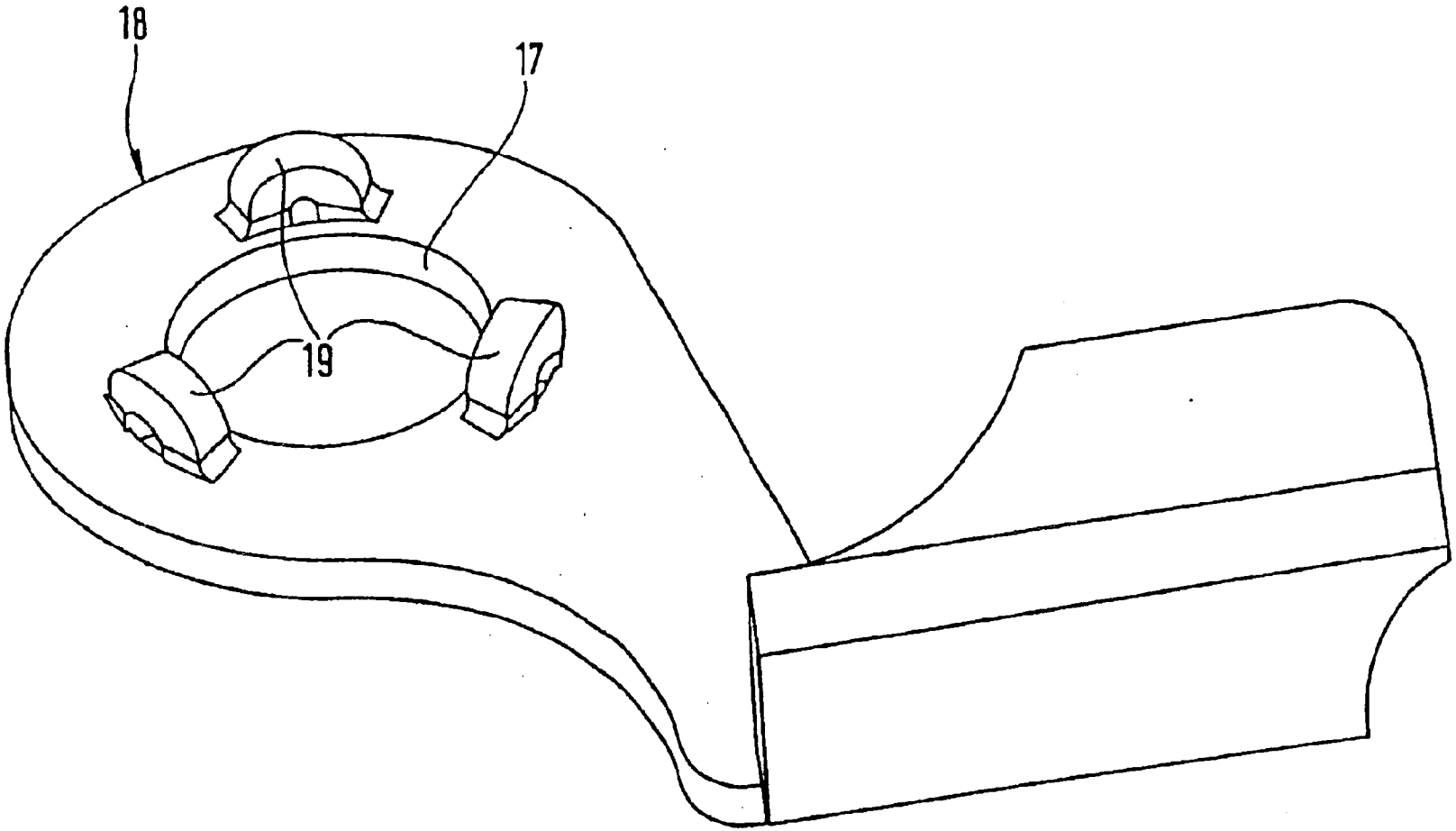
FIG. 5 a single diagram of an unlocking element.

The axle 15 passes through the bearing eye 17 of an unlocking lever 18 which is shown in a perspective view in FIG. 5 and can be pivoted out of its normal position, shown with solid lines in FIG. 3, into its unlocked position, shown with dotted lines, the purpose of which is to be explained in greater detail below. Three cams 19 whose cam faces have the shape of semicircular arcs are arranged centrally with the bearing eye 17 on the side of the unlocking lever 18 facing away from the base part 3.

Figure 6:
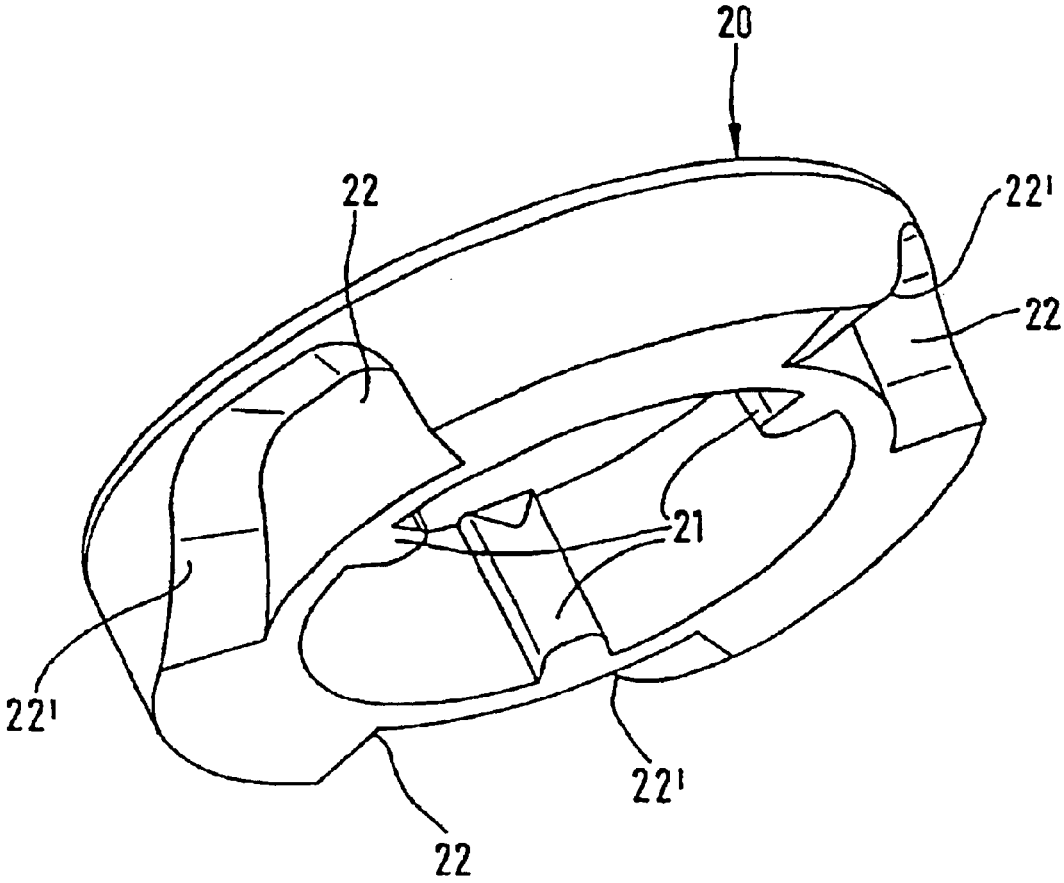
FIG. 6 a single diagram of a lifting ring that works together with the unlocking element.

In addition, the axle 15 passes through the lifting ring 20 which is shown in a perspective view in FIG. 6, axial webs 21 being integrally molded on its inside circumference in the axial grooves 16 of the axle, securing the lifting ring 20 so it cannot rotate relative to the axle 15, but permitting axial displacement of the lifting ring 20. The lifting ring 20 has link-type recesses 22 which are open toward its lower side and its outer circumference and work together with the cams 19 of the unlocking lever 18. In the normal position of the unlocking lever 18, the cams 19 are accommodated by recesses 22. When the unlocking lever 18 is pivoted into the unlocked position, the cams slide over the ramp-shaped flanks 22' of the recesses 22, so that the lifting ring 20 is necessarily adjusted from its lower normal position, illustrated in FIG. 3, into its raised unlocked position, which is assigned to the unlocked position of the unlocking lever 18 as shown with dotted lines in FIG. 3.

Finally, the axle 15 passes through a stepped central borehole 23 in the hand wheel 14. This central borehole 23 is designed so that its lower section, which is enlarged in a step shape, is adapted to the outer circumference of the lifting ring 20, while the section of the central borehole 23 having a smaller diameter is adapted to the outside diameter of the axle 15. Accordingly, the hand wheel 14 may assume its lower position illustrated in FIG. 3 only when the lifting ring 20 and the unlocking lever 18 assume their positions shown in FIG. 3.

Figure 4:
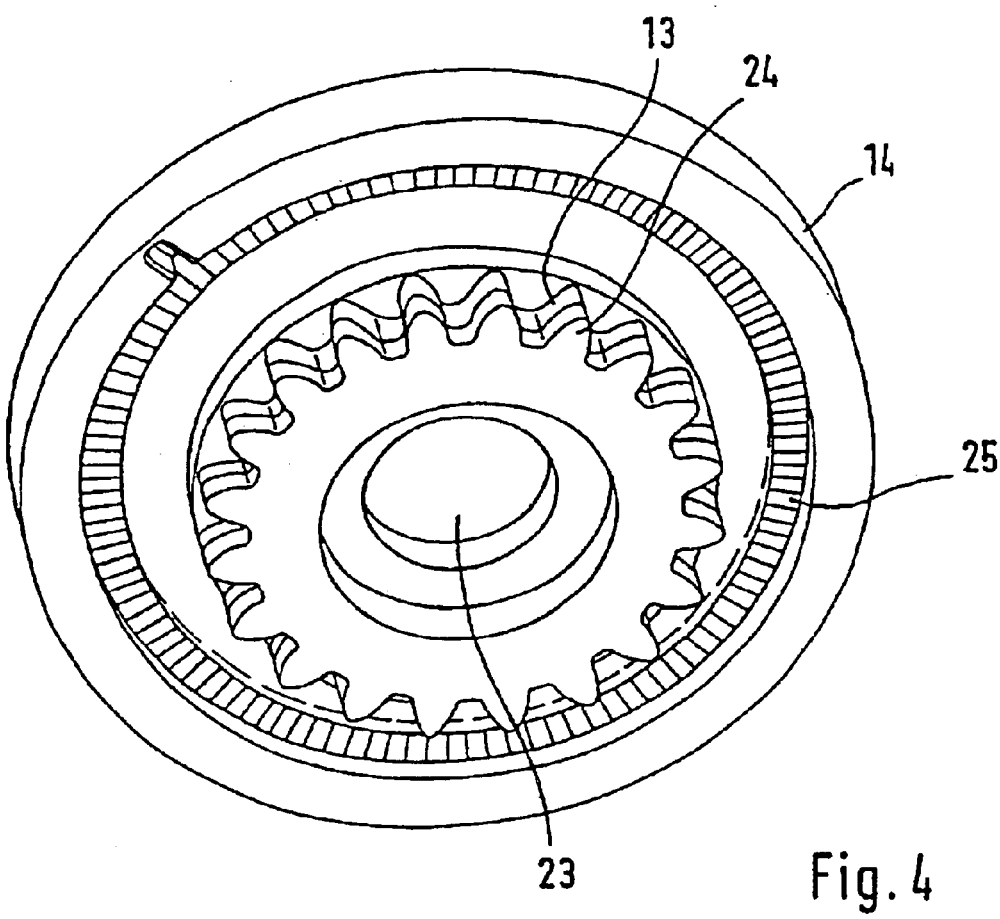
FIG. 4 a perspective view of an adjustment handle for adjusting the supporting parts.

As shown especially in FIG. 4, which shows a perspective view of the hand wheel 14 from beneath, the gearwheel 13 which is made of metal is injected into the hand wheel 14 made of plastic in such a way that another gearwheel 24 made of plastic and having the same contours is formed on the lower side of the gearwheel 13. The gearwheels 13 and 24 work together with the toothed racks 11 and 12 in a manner to be explained below.

Moreover, a fine gearing 25 in comparison with the gearing on gearwheels 13 and 24 is provided on the lower side of the hand wheel 14 in a radial plane above the gearwheel 13; its function will be explained in greater detail below.

A ring disk 27, whose outside circumference is enclosed by a ring web integrally molded on the top of the hand wheel 14, is attached to the upper end of the axle 15 by means of a screw 26 screwed into the inside thread borehole of the axle 15.

Beneath the ring disk 27 there remains an annular space 28 axially between the hand wheel 14 and the ring disk 27, surrounding the axle 15 and accommodating a ring-shaped cup-spring assembly 29 or a helical spring with a suitable diameter. This cup-spring assembly 29 or the helical spring is clamped axially between the ring disk 27 and the hand wheel 14 so that the hand wheel 14 is forced downward with a considerable force.

A housing part 30 is arranged fixedly relative to the base part 3 axially between the hand wheel 14 and the base part 3, having channels open toward its lower side to accommodate the toothed racks 11 and 12. A gearing ring 31 is integrally molded on the top side-of the housing part 30 and works together with the gearing 25 on the lower side of the hand wheel 14.

Beneath the toothed racks 11 and 12 are arranged supporting bodies on the housing part 30 or on the base part 3; these supporting bodies support the toothed racks 11 and 12 essentially only in the area of sectional plane III—III in FIGS. 1 and 2. For example, the supporting bodies 32 may be designed in the form of a roof with the tip of the roof falling in the sectional plane III—III.

The arrangement illustrated here functions as follows: Normally the hand wheel 14 sits in the normal position shown in FIG. 3. This is equivalent to hand wheel 14 meshing with its gearing 25 in the gearing ring 31 of the housing part 30 and blocking it in a rotationally fixed manner. In addition, in this position of hand wheel 14, the metal gearwheel 13 which is fixedly connected to it meshes with the gearing of the toothed racks 11 and 12, so that toothed racks 11 and 12 and the respective supporting parts 6 and 8 accordingly are also secured.

If the ski 1 executes flexing movements, i.e., if the ends of the skis are bent upward relative to the center of the ski, there is a certain sagging in the middle area of the ski, with the result that the supporting parts 6 and 8 are shifted slightly in the longitudinal direction of the ski on the base parts 2 and 4. In doing so, the distance of the ski boot holding parts 7 and 9 may also change slightly in the longitudinal direction of the ski. This does not matter for holding a ski boot (not shown) inserted into the ski boot holding parts 7 and 9, because these changes in distance are compensated by the fact that one of the ski boot holding parts 7 and 9, usually the ski boot holding part 9 on the heel end, has limited mobility in the longitudinal direction of the ski relative to the respective supporting part 6 or 8 and is pushed in the direction of the other ski boot holding part, respectively, by a thrust spring system (not shown).

With the above-mentioned flexing movements of the ski 1, the toothed racks 11 and 12 execute more or less marked pivoting movements with regard to a transverse axis of the ski in the area of supporting bodies 32. Due to the supporting bodies 32, it is reliably guaranteed that the meshing of the gearing on the toothed racks 11 and 12 in the gearing of the metal gearwheel 13 will be maintained.

Essentially, the ski 1 may also execute counter-flexing movements in which the ends of the ski are bent downward relative to the middle area of the ski. However, the middle area of the ski is practically not bent at all, so that base parts 2 and 4 and thus the supporting parts 6 and 8 carried in them and accordingly also the respective toothed racks 11 and 12 do not execute any counter-flexing movements relative to one another and the meshing between the metal gearwheel 13 and the gearing of the toothed racks 11 and 12 is reliably maintained.

If the unlocking lever 18 is pivoted from its normal position, shown with solid lines in FIG. 3, into the unlocked position shown with dotted lines, the cams 19 raise the lifting ring 20 so that the hand wheel 14 is also raised against the force of the spring system 29 and the gearing 25 of the hand wheel 14 is released from the gearing ring 31 of the housing part 20. The hand wheel 14 can thus be turned manually, so that in this rotating position of the hand wheel 14, the plastic gearwheel 24 adjacent to the metal gearwheel 13 cooperates with the toothed racks 11 and 12. By rotating the hand wheel 14, the supporting parts 6 and 8 and thus the ski boot holding parts 7 and 9 can be adjusted simultaneously to adjust their spacing to different boot sizes in the longitudinal direction of the ski. The length of the sole set in each case may optionally be read on a scale optionally provided on the hand wheel.14 which can work together with a mark on the housing part 30.

As soon as the desired ski boot length has been set, the unlocking lever 18 is reset from its unlocked position into the normal position, so that the cams 19 of the unlocking lever 18 can in turn assume a position beneath the recesses 22 on the lifting ring 20, and the spring assembly 29 puts the hand wheel 14 together with its lifting ring 20 in its lower end position. Thus the hand wheel 14 is again locked in a rotationally fixed manner by meshing of its gearing 25 with the gearing ring 31 of the housing part 30. At the same time, the unlocking lever 18 is locked in its normal position because the cams 19 are secured in the recesses 22 of the lifting ring 20, which is non-rotating relative to the axle 15, and thus the unlocking lever 18 is secured against rotation.

In deviation from the embodiment illustrated in the drawing, the gearing 25 of the hand wheel 14 and the gearing ring 31 of the housing part 30 which works together with it are omitted when, instead of that, the gearwheel 13 has a greater axial width and meshes with the gearing of the toothed racks 11 and 12 in the lower end position of the hand wheel 14 on the one hand and with immovable gearing (not shown here) on the housing part 30 beneath the lower side of toothed racks 11 and 12.

The advantage of the embodiment illustrated in the drawing is that the gearings 25 and 31 working together to lock the hand wheel 14 may be designed to be very fine, and the gearings of toothed racks 11 and 12 and that of gearwheel 13 may be designed to be comparatively large, as is advantageous for the pivotability of toothed racks 11 and 12 relative to a transverse axis in the meshing zone of the gearwheel 13 in toothed racks 11 and 12. The fine gearings 25 and 31 guarantee that the hand wheel 14 can be locked in rotational positions very close together.

Moreover, in deviation from the embodiment illustrated in the drawing, the unlocking lever 18 and the lifting ring 20 may also be omitted, and hand wheel 14 combined with or connected to the gearwheel 13, 24 may be gripped directly by hand to unlock it and lifted relative to ski 1 to perform a rotational adjustment.

In the embodiment in FIGS. 7 through 10, a pivot lever 40 which can rotate about the axle of the hand wheel 14 is provided, with which the hand wheel 14 together with its gearwheels 13 and 24 can be raised into its unlocked position relative to the ski as well as being lowered into its locked position. The arrangement is designed so that the handle of the pivot lever 40 projects laterally far beyond the longitudinal edge of the ski when the pivot lever is adjusted out of the position illustrated in FIG. 7, where the hand wheel 14 is locked, into the position in which the hand wheel 14 is unlocked.

Figure 7:
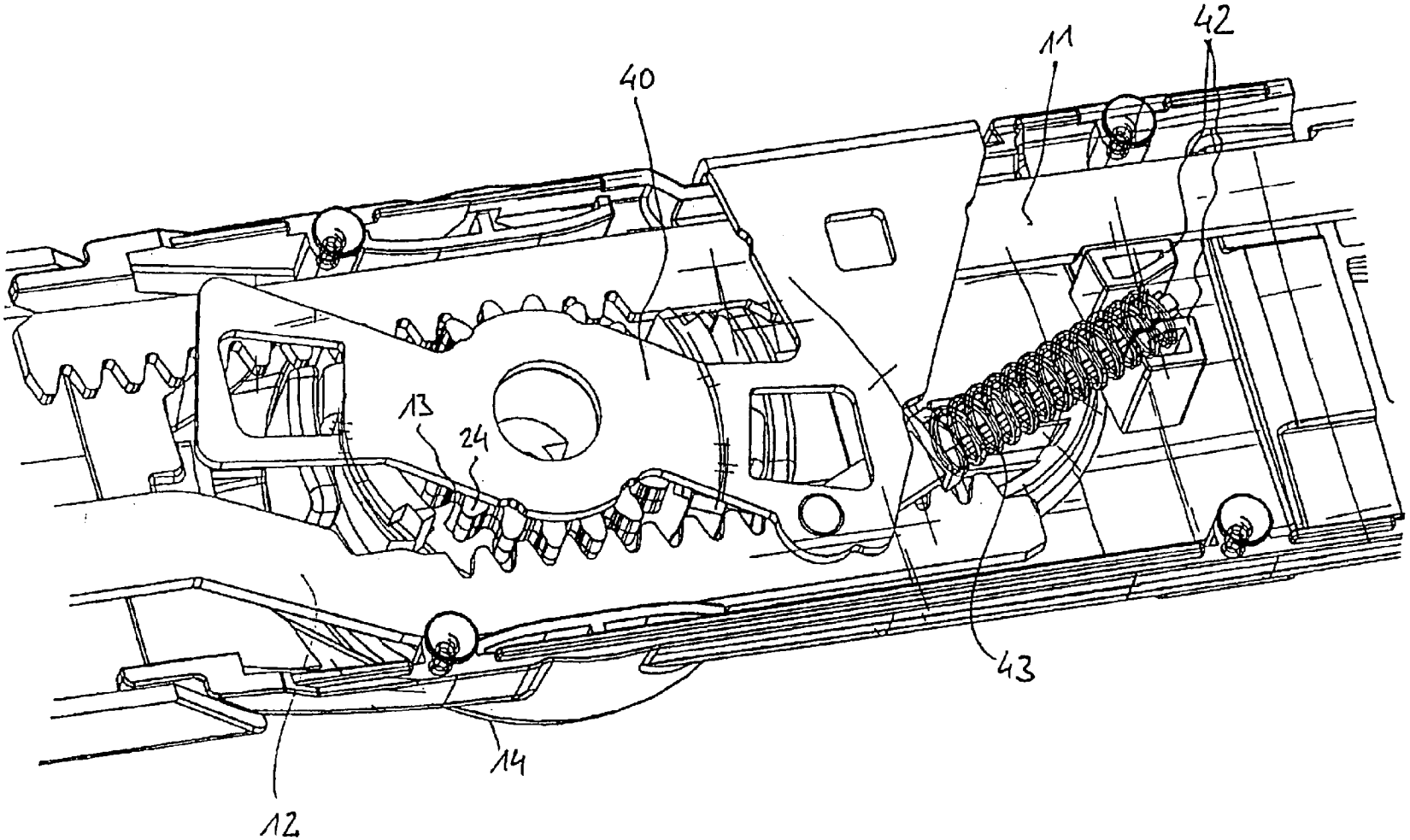
FIG. 7 a perspective view of a modified base arrangement as seen from beneath.

According to FIG. 7, the pivot lever 40 is connected to a guide rod 41 in an articulated connection which is displaceable guided between two stationary abutments 42. Between these abutments 42 and the end of the guide rod 41 on the pivot lever end, a helical spring 43 concentric with the guide rod 41 is clamped, applying tension to the pivot lever 40 in the position shown in FIG. 7, or it can be held in its other pivoted end position which is designed as top dead center.

Figure 9:
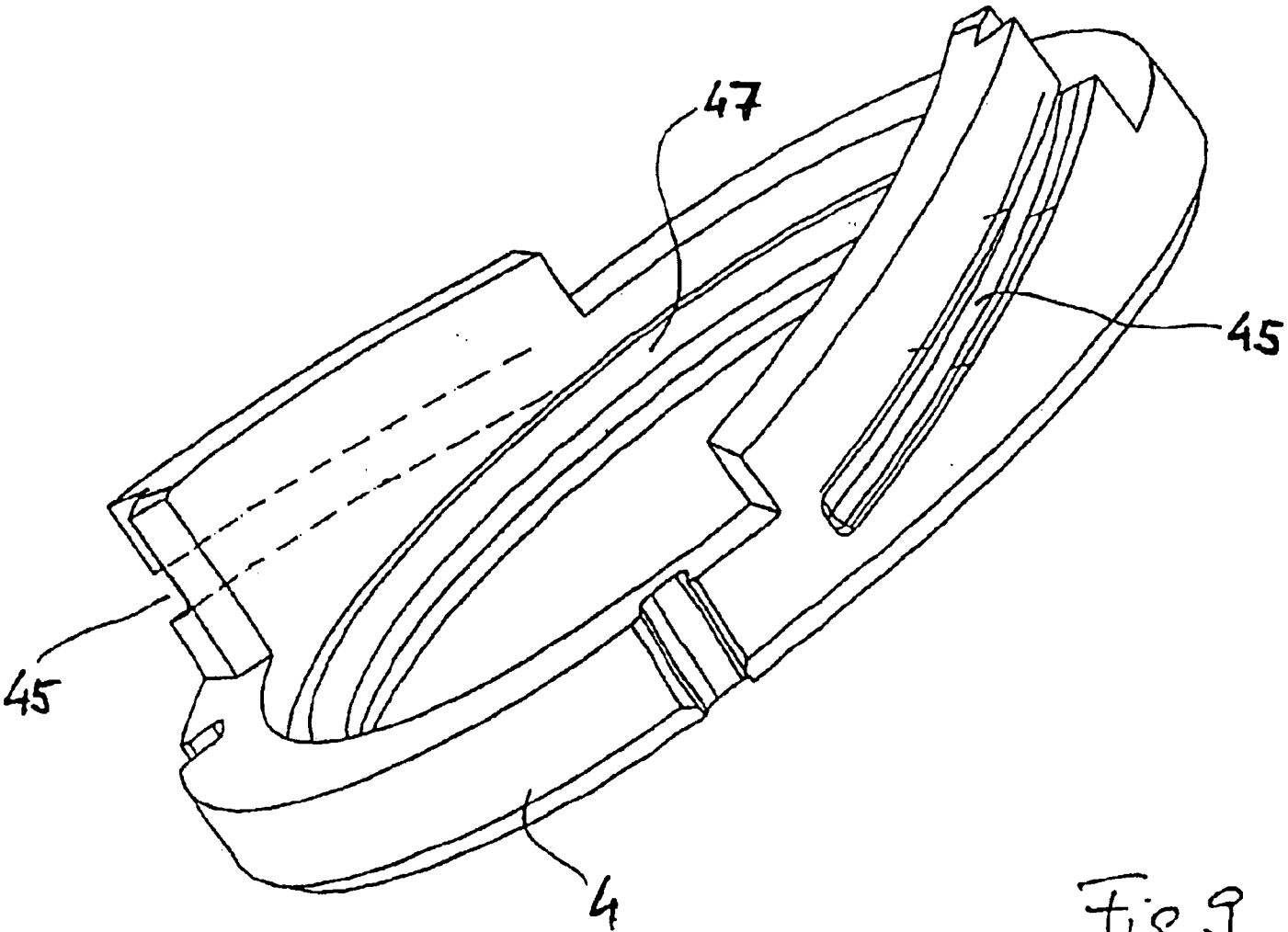
FIG. 9 the respective link ring.
Figure 10:
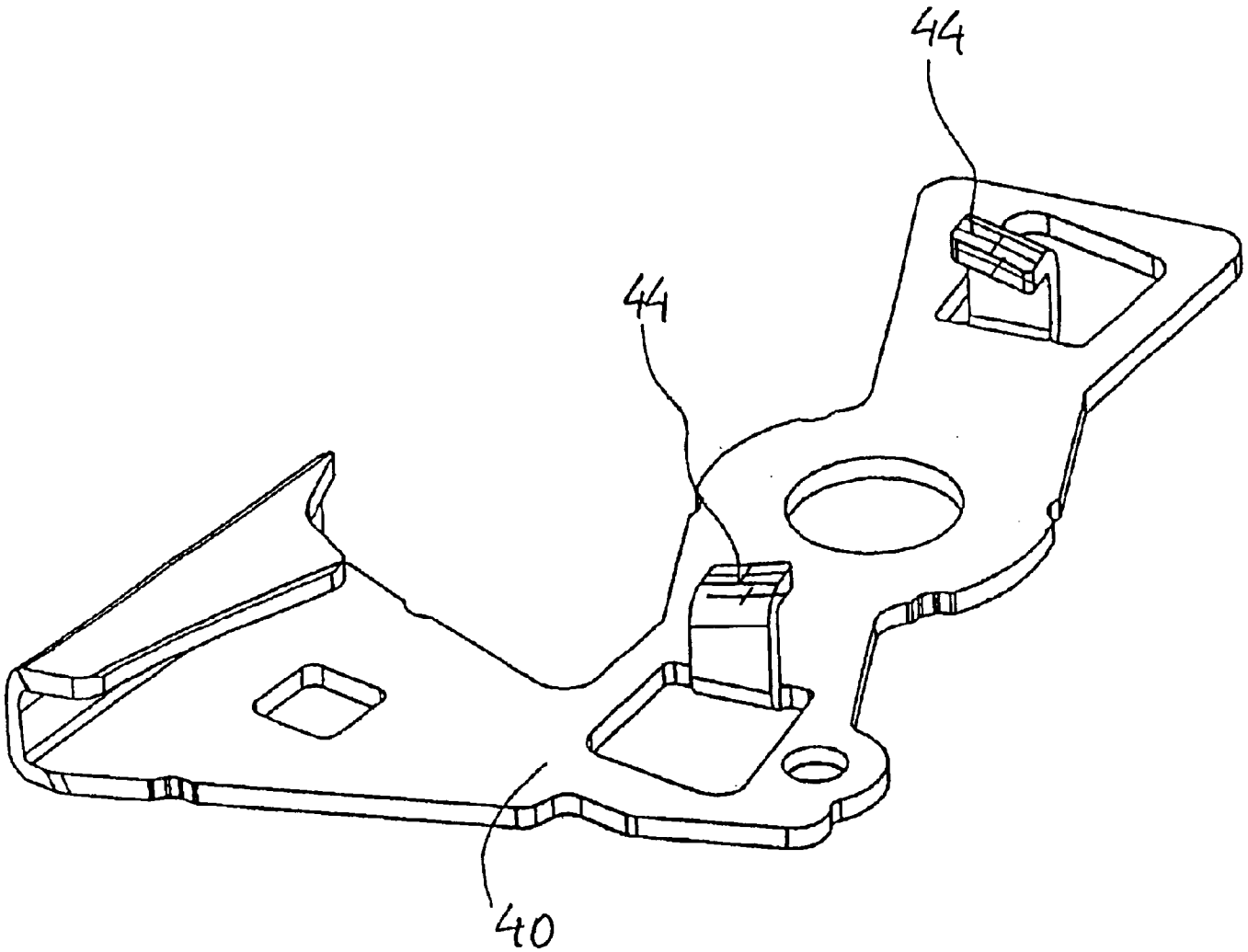
FIG. 10 the respective control lever.

According to FIG. 10, screw hooks 44 are punched on the pivot lever 40, engaging in helical grooves 45 of a link ring 46, shown in greater detail in FIG. 9, and held within the base part 3 so it is axially movable but non-rotatable.

Figure 8:
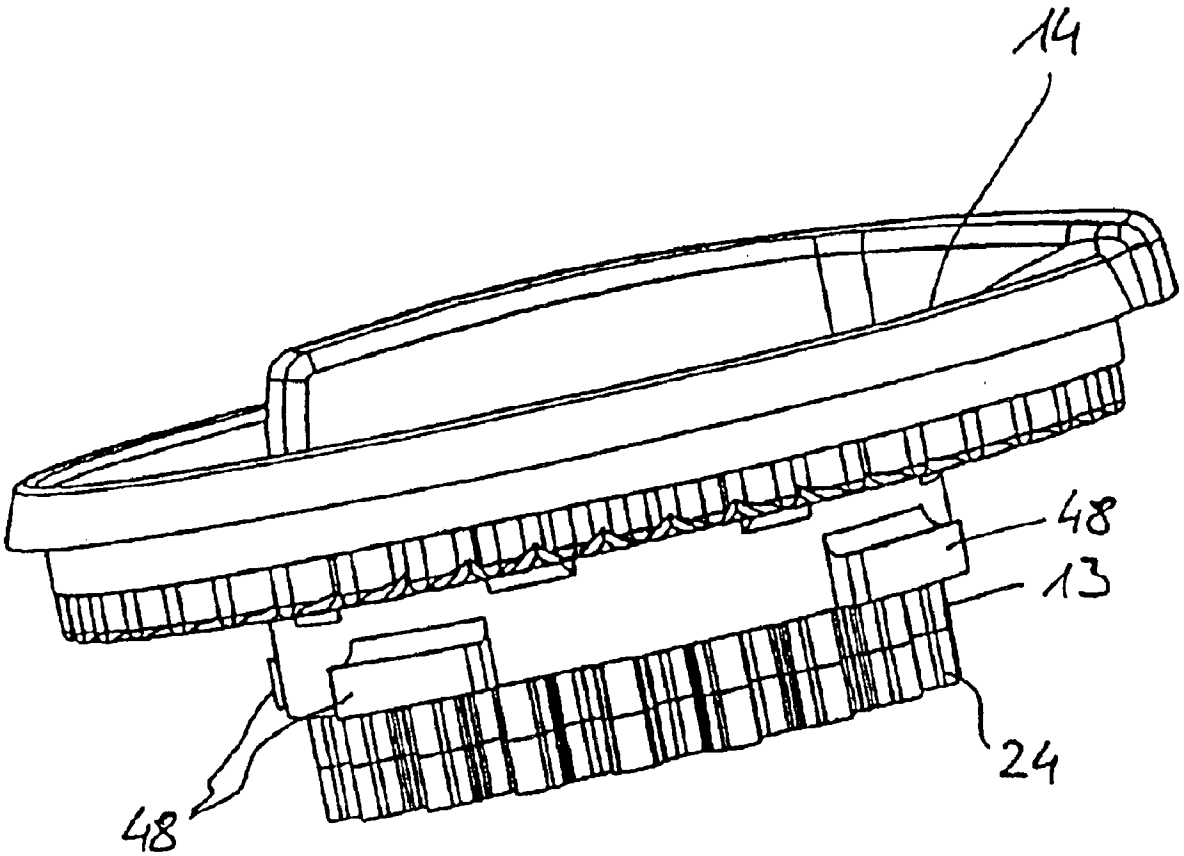
FIG. 8 the respective gearwheel.

This link ring 46 has an inner peripheral groove 47 meshing with the radial projections 48 arranged on the hand wheel 14 according to FIG. 8. To permit assembly of the link ring 46 on the hand wheel 14, the link ring 46 may be designed as a C-shaped spring ring which can be spread apart elastically to allow the radial projections 48 to be snapped into the inner peripheral groove 47.

When pivot lever 40 is pivoted about its pivot axis, the screw hooks 44 are displaced into the helical grooves 45 in the link ring 46 which is held non-rotatably, so that it executes an axial lifting movement in which the hand wheel 14 engaging with the radial projections 48 in the inner peripheral groove 47 of the link ring 46 is necessarily entrained. Thus, the hand wheel 14 can be adjusted in its locked position, lowered onto the ski, on the one hand and into its unlocked position which is raised relative to the ski on the other hand and in which the lifting ring 20 can be rotated by displacement of the toothed racks 11 and 12 (see FIG. 1).

Through the basic arrangement according to this invention, a very advantageous pressure distribution is achieved between ski 1 and the substrate in skiing.

Since the front and rear base parts 2 and 4 which are screwed to the ski 1 reach around the middle base part 3 on its top side from above, the weight of the skier, which is applied to the ski boot holding parts 7 and 9 on the front and rear base parts 2 and 4, or the load exerted by the skier on the ski is also transmitted to the ski to a great extent over the middle base part 3. This effect is especially pronounced when the ski 1 sags, i.e., when the ends of the ski 1 are bent upward relative to the center zone of the ski 1, as is the case when cornering, for example, with a marked use of the edges of the ski on the running surface of the ski 1, especially in the so-called carving technique. In such bending movements of the ski 1, the middle base part 3 attempts to approach the top side of the ski vertically from overreaching parts of the base parts 2 and 4 from above, with the result that the middle base part 3 is pressed to a greater extent against the top side of the ski and the bottom pressure of the middle zone of the ski or the ski edge engaging at the bottom is greatly increased in the area of the middle zone, so the bottom pressure reaches a maximum in the area of the middle zone of the running surface or the edge of the ski 1 used, and it decreases continuously in both forward and reverse directions in the longitudinal direction of the ski.

Therefore, the three-part design of the basic arrangement shown here is also advantageous if an arrangement for simultaneous adjustment of the ski boot holding parts 7 and 9 for adjusting to the respective ski boot length is omitted. With such an arrangement, the ski boot holding parts 7 and 9 are arranged in an essentially fixed manner according to a predefined ski boot size on the front and rear base parts 2 and 4, with a ski boot holding part, usually the ski boot holding part 9 on the heel end, is displaceable in the longitudinal direction of the ski against the above-mentioned thrust spring system, to the rear in the case of the ski boot holding part 9 on the heel end to prevent unwanted tension between the ski 1 and the rigid sole of the ski boot when there are bending movements of the ski 1. The middle base part forms a "filler part" between the other base parts 2 and 4, this part in turn being pressed against the top side of the ski from the iddle base part 3 by the overreaching parts of the other base parts 2 and 4 or being pressed with increased force against the top side of the ski when there is sagging of the ski 1.

In all embodiments, the middle base part 3 can thus be held vertically rigidly on the ski 1 by the parts of the other base parts 2 and 4 reaching over this base part 3 from above.

For holding in the longitudinal and transverse directions of the ski, the middle base part 3 may be connected to one of the other base parts 2 and 4, e.g., base part 4, in such a way that it is flexible or can be pivoted about a transverse axis of the ski, e.g., by a flexible sole in the form of a flat strip on the bottom side of the two base parts 3 and 4 connected together. In this arrangement, the middle base part 3 should be arranged so it is displaceable in the longitudinal direction of the ski relative to the top side of the ski and the base part 2 which is separate from base part 3.

Essentially, the middle base part 3 may also be secured on the ski 1. Again in this case, the above-mentioned pressure distribution between the ski 1 and the substrate in skiing is also achieved if the base parts 2 and 4 arranged in a fixed position on the ski extend over the middle base part 3 on its front and rear end areas and press against the top side of the ski, especially with bending movements of the ski 1.

In all these embodiments, the parts of the other base parts 2 and 4 reaching over the top side of the middle base part 3 from above should slide well on the base part 3. In addition, transverse joints should be arranged at both ends of the base part 3 between the adjacent base parts 2 and 3 as well as 3 and 4 beneath the parts of the base parts 2 and 4 which extend over the base part 3 from above. These measures guarantee a good flexibility of the ski 1.

A pressure distribution that is at least partially improved is also achieved when only one of the base parts 2 and 4 extend over the middle base part 3 from above.

The invention has been described with particular emphasis on the preferred embodiments, but variations and modifications within the spirit and scope of the invention may occur to those skilled in the art to which the invention pertains.

What is claimed is:

1. A basic arrangement of a ski binding having a front boot holding part or a toe end for securing a ski boot, a first base part fixed on the ski, a front supporting part longitudinally displaceable on the first base part, said front supporting part supporting the front boot holding part, a rear boot holding part or a heel end for securing the ski boot, a second base part fixed on the ski, a rear supporting part longitudinally displaceable on the second base part, said rear supporting part supporting the rear boot holding part, a rack-and-pinion gear adjusting device for simultaneous adjustment of both said front supporting part and said rear supporting part, said device having two toothed racks, the first rack connected to the front supporting part and the second rack connected to the rear supporting part, and a manually operable, lockable gearwheel which meshes with both toothed racks between the two supporting parts, wherein the gearwheel has a locked position in a fixed position on the ski, and the toothed racks are arranged pivotally about a transverse axis of the ski in the meshing zone of the gearwheel, and the gearwheel has an unlocked position which is raised vertically relative to the top side of the ski for the rotational adjustment and a locked position which is depressed toward the top side of the ski.

2. A basic arrangement according to claim 1, wherein a spring system holds the gearwheel under tension in the locked position.

3. A basic arrangement according to claim 1, wherein the gearwheel adjoins a plastic hand wheel and a second gearwheel which has the same contour as the gearwheel and when said gearwheel is in the locked position, said second gearwheel works together with the toothed racks and when said gearwheel is in the unlocked position, said gearwheel works together with the toothed racks.

4. A basic arrangement according to claim 2, wherein the gearwheel and the second gearwheel have a lower position or a catch position secured by the spring system and are lifted by a lifting device against the force of the spring system.

5. A basic arrangement according to claim 1, wherein a lever lifts the gearwheel out of the locked position and adjust into the locked position, with the lever projecting over a longitudinal edge of the ski when the gearwheel is unlocked.

6. A basic arrangement according to claim 5, wherein a spring arrangement under tension puts the lever into the position locking the gearwheel, and the position of the lever unlocking the gearwheel is top dead center.

7. A basic arrangement according to claim 3, wherein said gearwheel is metal.

8. A basic arrangement according to claim 3, wherein said second gearwheel is plastic.

9. A basic arrangement of a ski binding having;

a front boot holding part or a toe end for securing a ski boot;

a first base part fixed on the ski;

a front supporting part longitudinally displaceable on the first base part, said front supporting part supporting the front boot holding part;

a rear boot holdings part or a heel end for securing the ski boot;

a second base part fixed on the ski;

a rear supporting part longitudinally displaceable on the second base part, said rear supporting part supporting the rear boot holding part;

a rack-and-pinion gear adjusting device for simultaneous adjustment of both said front supporting part and said rear supporting part, said device having two toothed racks, the first rack connected to the front supporting part and the second rack connected to the rear supporting part, and a manually operable, lockable gearwheel which meshes with both toothed racks between the two supporting parts;

a third base part in an essentially stationary mount on the ski, said third base part being separate from the first and second base parts and said third base part being held indirectly on the ski by the first and second base parts to restrict movement of said third base part, wherein the gearwheel is arranged on the third base part, and the gearwheel has a locked position in a fixed position on the ski, and the toothed racks are arranged pivotally about a transverse axis of the ski in the meshing zone of the gearwheel, wherein the gearwheel is fixedly arranged or integrally molded on a hand wheel, and the hand wheel and the gearwheel have a vertically raised position with respect to the top side of the ski for the rotational adjustment, a locked position depressed toward the top side of the ski, and a meshing position wherein at least one of the gearwheel or a gearing provided on the hand wheel meshes with a stationary lock gearing and works together with the lock gearing.

* * * * *